US007817814B2

(12) United States Patent
Yang

(10) Patent No.: US 7,817,814 B2
(45) Date of Patent: Oct. 19, 2010

(54) MULTIPLE CHANNEL EARPHONE

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 1148 days.

(21) Appl. No.: 11/308,902

(22) Filed: May 24, 2006

(65) Prior Publication Data

US 2007/0195984 A1 Aug. 23, 2007

(30) Foreign Application Priority Data

Feb. 20, 2006 (TW) ..... 95105609 A

(51) Int. Cl.
*H04R 25/00* (2006.01)

(52) U.S. Cl. ..... 381/371; 381/309; 381/382

(58) Field of Classification Search ..... 381/300, 381/307, 309, 335, 337, 338, 370, 371, 372, 381/376, 382; 379/430; 181/129; 2/209
See application file for complete search history.

(56) References Cited

U.S. PATENT DOCUMENTS

| | | | | |
|---|---|---|---|---|
| 7,155,025 | B1 * | 12/2006 | Weffer | 381/370 |
| 7,289,641 | B2 * | 10/2007 | Yang | 381/382 |
| 7,463,748 | B2 * | 12/2008 | Yang | 381/370 |
| 2003/0103637 | A1 * | 6/2003 | Huang | 381/309 |
| 2005/0205350 | A1 | 9/2005 | Yang | 181/160 |
| 2005/0207606 | A1 | 9/2005 | Yang | 381/370 |
| 2005/0207607 | A1 | 9/2005 | Yang | 381/382 |
| 2005/0238189 | A1 * | 10/2005 | Tsai | 381/309 |

FOREIGN PATENT DOCUMENTS

| | | |
|---|---|---|
| CN | 1226797 | 8/1999 |
| CN | 2450845 | 9/2001 |
| DE | 23 35 201 | 2/1975 |

OTHER PUBLICATIONS

"1st Office Action of China counterpart application", issued on Mar. 13, 2009, p. 1-p. 9.
"2nd Office Action of China counterpart application", issued on Oct. 9, 2009, p. 1-p. 10.

* cited by examiner

*Primary Examiner*—Huyen D Le
(74) *Attorney, Agent, or Firm*—Jianq Chyun IP Office

(57) ABSTRACT

The present invention relates to a multiple channel earphone of small volume. In the earphone structure, a chamber tube with an adjusting hole or a set of adjusting holes is provided. The sound pressure of the chamber tube is naturally released without affected the performance of the main chamber sound field. When the external speaker connected to the chamber tube generates a large sound pressure, the sound pressure released naturally by the adjusting hole or a set of adjusting holes is increased accordingly, so that the sound pressure produced by the external speaker connected to the chamber tube is controlled by the main chamber.

19 Claims, 10 Drawing Sheets

MULTIPLE CHANNEL EARPHONE

CROSS-REFERENCE TO RELATED APPLICATION

This application claims the priority benefit of Taiwan application serial no. 95105609, filed on Feb. 20, 2006. All disclosure of the Taiwan application is incorporated herein by reference.

BACKGROUND OF THE INVENTION

1. Field of Invention

The present invention relates to a multiple channel earphone, and more particularly to a multiple channel earphone with extended sound field and adjusting holes.

2. Description of Related Art

Our daily lives have been digitalized along with the development of digital technology. For example, digital video disc (referred as DVD generally) player has become a common video playing apparatus in our homes. Since the DVD player has Dolby Digital or Digital Theater System (DTS) decoding function, it can be used for decoding digital signals and output analog signals to speakers.

To obtain high quality digital video entertainment, multiple channel speakers are the necessary equipments, and 5.1 channel speakers are the basic multiple channel speakers.

FIG. 1 is a diagram of a home theater system with 5.1 channel speakers. Referring to FIG. 1, while the DVD player 100 is playing a video program, different sound signals are respectively output to a front left speaker 102*a*, a front right speaker 102*b*, a center speaker 104, a surround left speaker 106*a*, a surround right speaker 106*b* and a subwoofer speaker 108 to produce 3-D (three dimension) sound effect and high fidelity.

However, earphones have to be used while it's not suitable for playing sound through speakers (for example, which may disturb others). Referring to FIG. 2A, in general, the user of an earphone cannot enjoy multiple channel sound effect output from the DVD player since only one speaker 210 is disposed at both sides of the earphone 200*a*.

Thus, a conventional earphone having a plurality of internal speakers is provided, as shown in FIG. 2B. A front speaker 202, a center speaker 204, and a surround speaker 206 are disposed at each side of the earphone 200*b*, and with a specially designed plug 208, the sound signals of different channels can be output by the DVD player to different speakers through the plug 208. The sound effect of the 5.1 channel speakers in the home theater system as shown in FIG. 1 can be produced. In the conventional earphone 200*b*, the delay of the output sound signals can be controlled digitally (for example, through circuit design), however, the output sound field is not ideal compared to the 5.1 channel speakers in the home theater system as shown in FIG. 1, therefore, the quality and performance of the multiple channel surround sound effect cannot be achieved.

SUMMARY OF THE INVENTION

Accordingly, the present invention is directed to provide a multiple channel earphone, which can improve the output sound effect, and can provide profuse sound field and the multiple channel surround sound effect.

The present invention provides an earphone structure of small volume. In the earphone structure, an adjusting hole is disposed in the chamber tube, so that the sound pressure of the chamber tube is naturally released, and while the pipe is at its shortest status, the sound pressure of the chamber tube does not affect the performance of the main chamber sound field. While the external speaker connected to the chamber tube generates a large sound pressure, the sound pressure naturally released through the adjusting hole is increased accordingly, so that the sound pressure generated by the external speaker connected to the chamber tube is controlled in the main chamber. While the external speaker connected to the chamber tube generates a small sound pressure, the sound pressure naturally released through the adjusting hole is reduced accordingly, so that the sound generated by the external speaker connected to the chamber tube can still be heard clearly in the main chamber.

To achieve the aforementioned objectives, the present invention provides an earphone structure, which includes a main body, a main speaker, a plurality of sub-speakers, and an extended chamber pipe. Wherein the main body includes a case, a cover, and a case extension for forming the main chamber. The main speaker and some of the sub-speakers are disposed in the case. The extended chamber pipe is disposed on the main body and has an adjusting hole or a set of adjusting holes for adjusting the sound field in the earphone structure.

The aperture of the foregoing adjusting hole or a set of adjusting holes can be designed according to the size or frequency of the chamber of the extended chamber pipe, and the arrangement of the set of adjusting holes can also be adjusted according to different design.

The foregoing earphone structure further includes a pipe connected to the main body, and the chamber tube is disposed at the outmost edge of the pipe so as to form a resonate chamber in the chamber tube. Wherein the chamber tube has an adjusting hole, the sound wave in the resonating chamber is transmitted to the sound field in the main body through air by using the pipe, and the sound pressure in the chamber tube is released through the adjusting hole.

According to another embodiment of the present invention, an earphone structure is provided, which includes a main body, a main speaker, a plurality of sub-speakers, and a chamber tube. The main body includes a case, a cover, and a case extension for forming a main chamber tube. The main speaker and the sub-speakers are disposed in the case. The chamber tube is disposed at the external of the case extension for forming a resonate chamber in the chamber tube. Wherein the chamber tube has an adjusting hole or a set of adjusting holes, and the sound pressure in the chamber tube is released through the adjusting hole or the set of adjusting holes while the sound wave in the resonate chamber is transmitted to the sound field in the main body through air.

According to another embodiment of the present invention, an earphone structure is provided, which includes a main body, a main speaker, a plurality of sub-speakers, and a chamber tube. The main body includes a case, a cover, and a case extension for forming a main chamber tube. The main speaker and the sub-speakers are disposed in the case. The chamber tube is disposed at the external of the case for forming a resonate chamber in the chamber tube. Wherein the chamber tube has an adjusting hole or a set of adjusting holes, and the sound pressure in the chamber tube is released through the adjusting hole or the set of adjusting holes while the sound wave in the resonate chamber is transmitted to the sound field in the main body through air.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
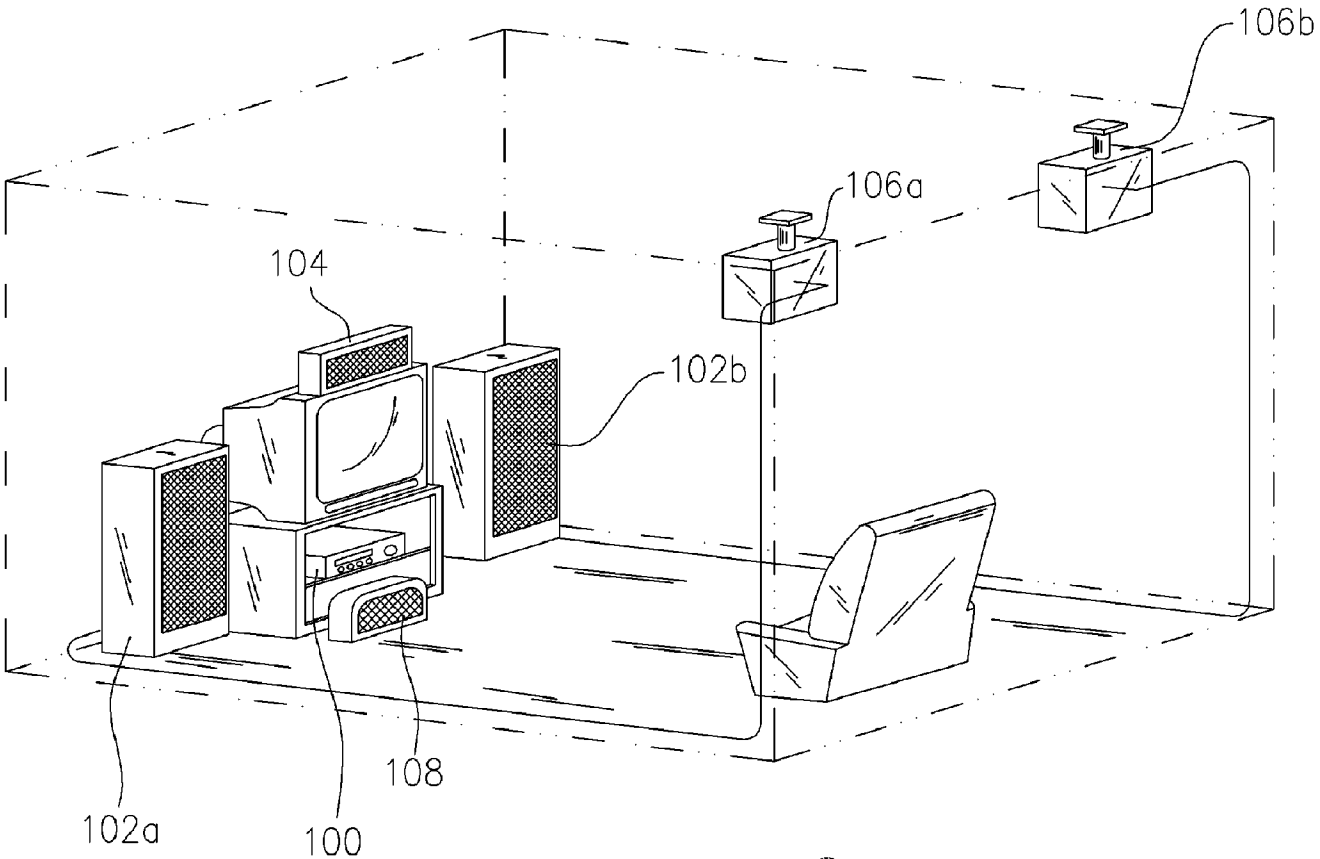
FIG. 1 (PRIOR ART)
FIG. 1 is a diagram of a home theater system with 5.1 channel speakers.
Figure 2A:
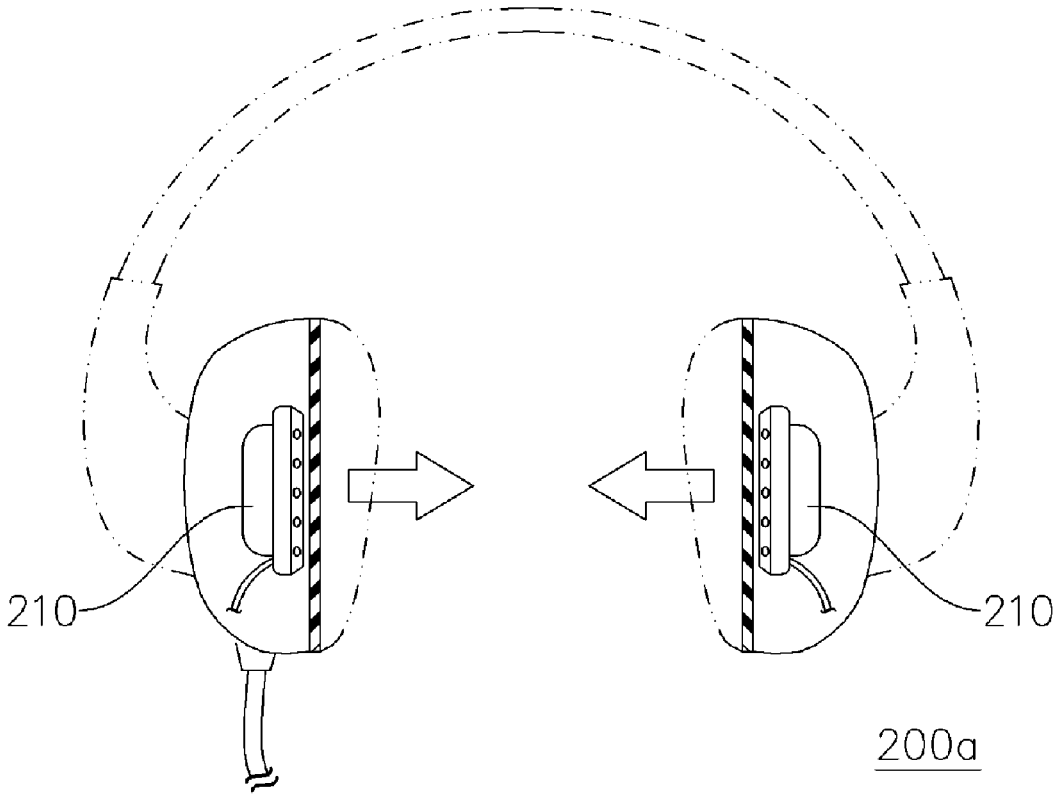
FIG. 2A (PRIOR ART)
FIG. 2A is a side cross-sectional view of a conventional earphone.
Figure 2B:
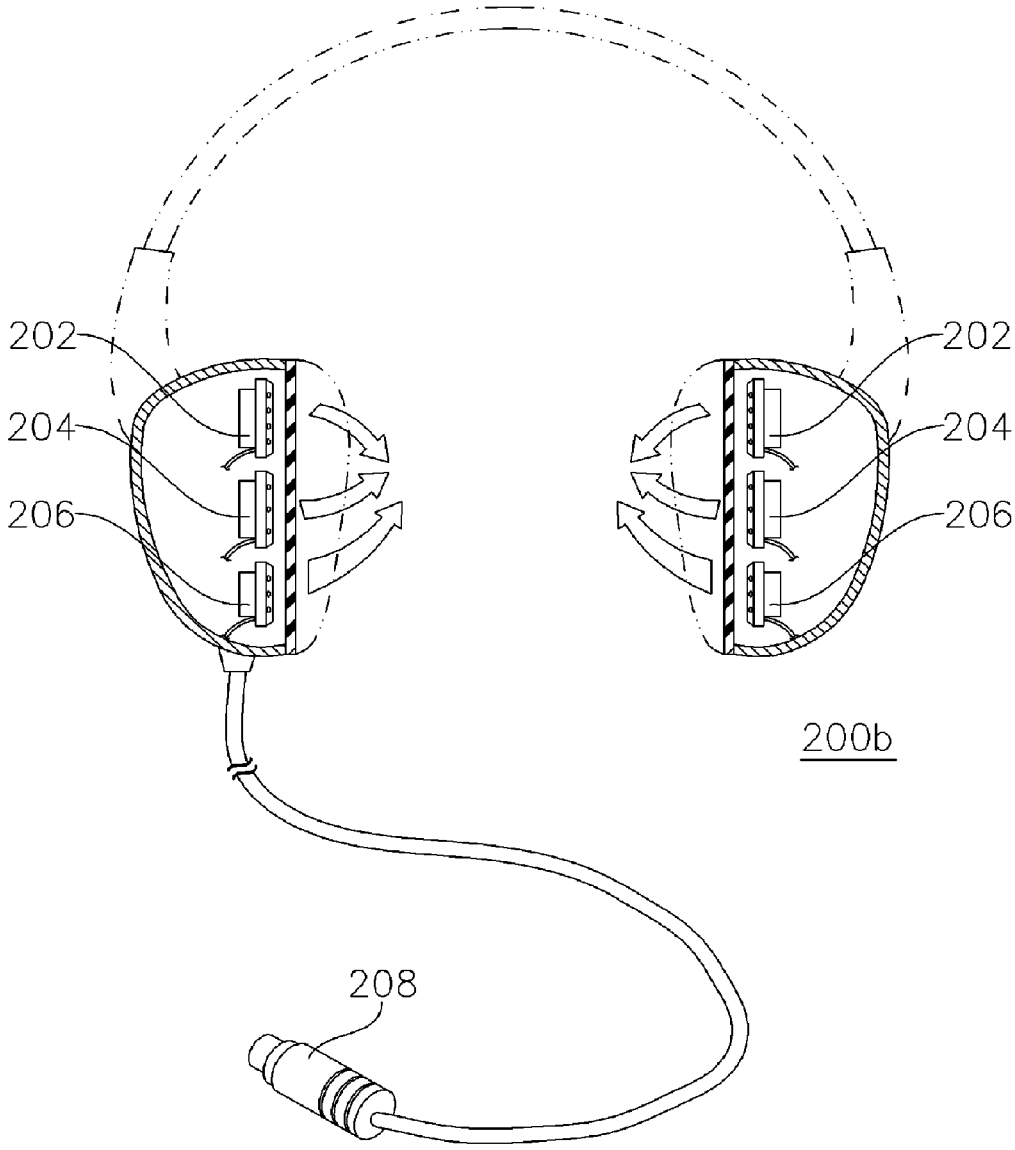
FIG. 2B (PRIOR ART)
FIG. 2B is a side cross-sectional view of another conventional earphone.

A Taiwan Patent Application No. 93107218 with the title of "SPEAKER MODULE FRAME, SPEAKER MODULE WITH THE FRAME AND ELECTRONIC APPARATUS WITH THE MODULE" was filed by the applicant of the present invention on 18 Mar. 2004, and its corresponding U.S. patent application "SPEAKER MODULE FRAME, SPEAKER MODULE THEREWITH, AND ELECTRONIC DEVICE WITH SPEAKER MODULE" was filed on May 7, 2004, Ser. No. 10/709,468. This invention was further improved and a Taiwan Patent Application No. 93111985 with the title of "EARPHONE STRUCTURE WITH COMPOSITE SOUND FIELD" was filed on 29 Apr. 2004 and granted with patent right, Taiwan Patent No. 1239784. Its corresponding U.S. patent application "EARPHONE STRUCTURE WITH A COMPOSITE SOUND FIELD" was filed on Jun. 9, 2004, Ser. No. 10/709,956. The entirety of each of the above-mentioned patent applications is hereby incorporated by reference herein and made a part of this specification. In these patent applications, an earphone structure is provided, which has a composite chamber tube disposed on a case and a cover. The case and the cover are used for covering the composite chamber tube. The composite chamber tube is used for receiving a plurality of sound source signals or sound from speakers and for forming a composite chamber, so that the source signals or the sound from speakers can form a composite sound field.

A Taiwan Patent Application No. 94103553 with the title of "MULTIPLE CHANNEL EARPHONE" was further filed on 4 Feb. 2005, and its corresponding U.S. patent application "MULTIPLE CHANNEL EARPHONE" was filed on Mar. 17, 2005, Ser. No. 10/907,047. The entirety of each of the above-mentioned patent applications is hereby incorporated by reference herein and made a part of this specification. In this invention, a multiple channel earphone is provided, which has an extended chamber pipe disposed on the main body of the earphone. The main body of the earphone includes a case and a cover of the earphone structure. The case and the cover of the earphone structure are used for forming a chamber tube. The depth and extent of the sound field is increased through adjusting the structure of the extended chamber pipe. The structure of the extended chamber pipe can be adjusted through retracting or folding method. In an embodiment, any signal from one of the speakers for the 5.1 channel source output by the DVD player can be pulled out from the chamber pipe of the main body independently, and the size of the chamber can be adjusted through retracting the chamber pipe formed by the extension pipe with the retracting function. The extension pipe does not occupy too much system space when it is retracted. The sound field space of the entire system is increased while the extension pipe is drawn out. In addition, since one of the signal tubes can be pulled out independently and disposed on the chamber pipe while the extension pipe is drawn out, the sound field effect can be deepened.

According to the foregoing multiple channel earphone, an independent sound field is formed through the resonance produced by the speaker and tube, so that the case and cover of the earphone structure can form a sound field to partition the sound field physically. Since the pipe is the path of the external speaker connected to the chamber tube and the main body, the length thereof determines the sound pressure from the external speaker connected to the chamber tube to the main body. The longer the pipe, the sound pressure produced by the resonance of the chamber tube to the main body is smaller, and a smaller interference is produced with the main sound field in the main body, so that a larger space is formed to the entire sound field.

Because this structure is formed by the pipe and the chamber out of the main body, in consideration of the volume design of the entire earphone structure, long pipe usually causes the size of the earphone to be too large, which is inconvenient, thus the applicant further provides an earphone structure of smaller volume in the present invention. According to the earphone structure of the present invention, an adjusting hole or a set of adjusting holes is disposed in the chamber tube to naturally release the sound pressure in the chamber tube, and while the pipe is at its shortest status, the sound pressure in the chamber tube does not affect the entire performance of the main chamber sound field. When the external speaker connected to the chamber tube produces a large sound pressure, the sound pressure released naturally by the adjusting hole is increased accordingly, so that the sound pressure produced by the external speaker connected to the chamber tube is controlled by the main chamber. When the external speaker connected to the chamber tube produces a small sound pressure, the sound pressure released naturally by the adjusting hole or a set of adjusting holes is reduced accordingly, so that the sound produced by the external speaker connected to the chamber tube can still be heard clearly in the main chamber.

According to the present invention, the adjusting hole or a set of adjusting holes is selectively added according to the design of the chamber tube of any signal tubes of the 5.1 channel sound source output by the DVD player. The apertures of the foregoing adjusting hole or a set of adjusting holes can be designed according to the size or frequency of the chamber tube of the extended chamber pipe, and the arrangement of the holes in the set of adjusting holes can be adjusted according to different design.

Figure 3A:
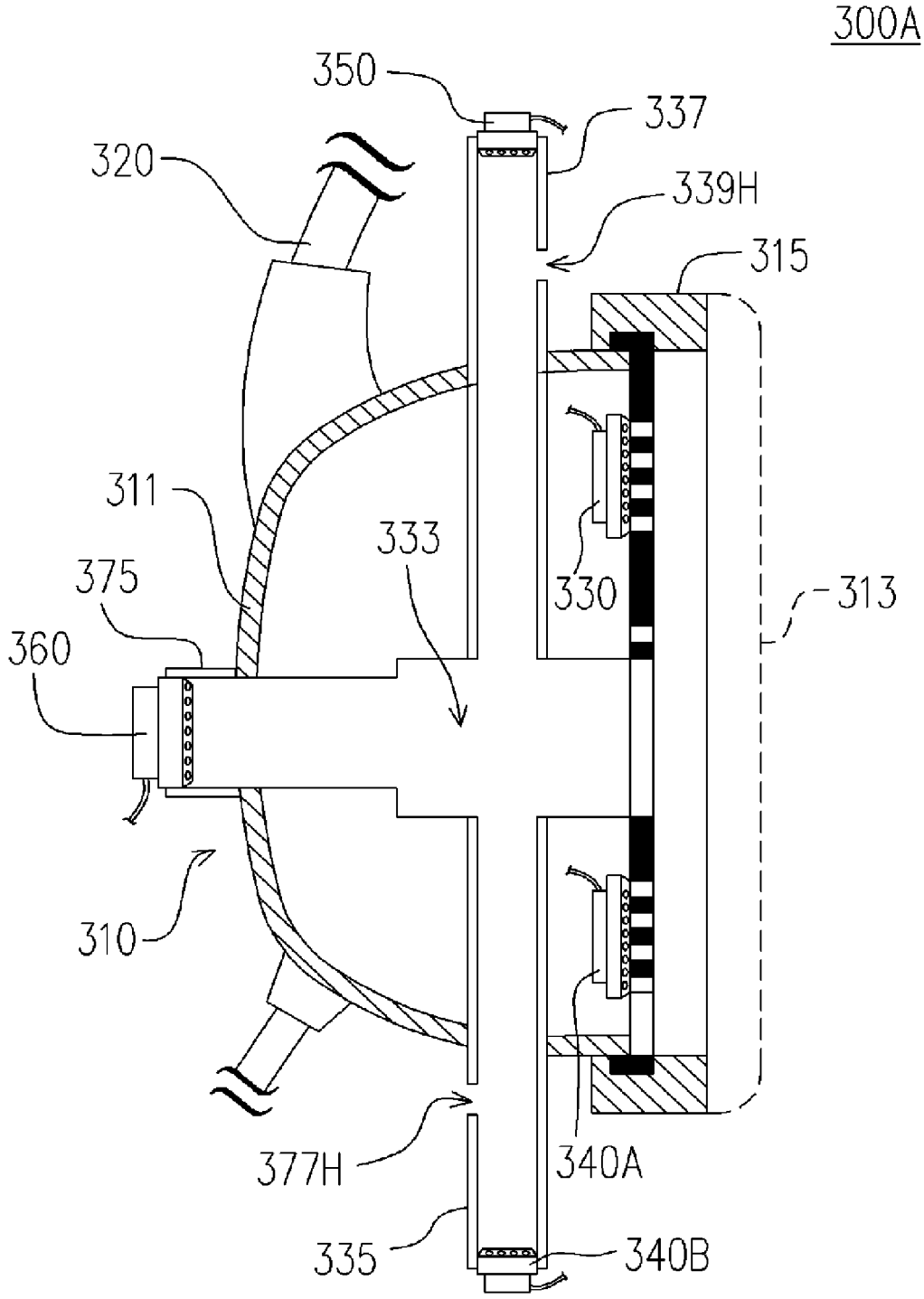
FIG. 3A is a partial side cross-sectional diagram of an earphone according to an embodiment of the present invention.

The present invention will be described and become more apparent from the detailed description of exemplary embodiments when read in conjunction with accompanying drawings. However, the following embodiments are only for the convenience of description, but not for limiting the present invention. FIG. 3A is a partial side cross-sectional diagram of an earphone 300A according to an exemplary embodiment of the present invention. It is remarkable that even FIG. 3A only illustrates one side of the earphone of the present invention, it should be understood by those skilled in the art that the structure of the other side not illustrated in FIG. 3A is the same as the side illustrated in FIG. 3A and so will not be described again.

Referring to FIG. 3A, the earphone 300A includes a main body 310 and a connector 320. Wherein, the connector 320 is used for connecting the main bodies 310 (only one is illustrated in the figure) at two sides of the earphone 300A. The main body 310 is formed by a case 311, a cover 313, and a case extension 315, and the case extension 315 is the extension of the case 311 and is connected to the cover 313. The main body 310 includes a main speaker 330 and a plurality of sub-speakers 340A, 340B, 350, and 360. The sub-speakers 340B and 350 are respectively disposed on the sidewalls of both sides of the composite chamber tube 333 through the extended chamber pipes 335 and 337. In another embodiment, the sub-speakers 340B and 350 can also be respectively disposed on the sidewalls of both sides of the composite chamber tube 333 directly. In addition, an extended chamber pipe 375 for disposing sub-speaker 360 is further included. The extended chamber pipes 335 and 337 have adjusting holes 377H and 339H respectively. Here adjusting hole is defined as a hole for naturally releasing sound pressure. And the adjusting hole can be replaced by a set of adjusting holes.

The extended chamber pipe 375 in FIG. 3A is disposed on the case 311 of the main body 310 and extends from the composite chamber tube 333 directly. The case 311, the cover 313, and the case extension 315 of the earphone 300A form a main chamber. The adjusting holes 377H and 339H are disposed in the chamber tube formed by the extended chamber pipes 335 and 337 so as to naturally release the sound pressure in the chamber tube. And while the pipe is at its shortest status, the sound pressure in the chamber tube does not affect the performance of the main chamber sound field. While the sub-speakers 340B and 350 connected to the chamber tube generate a large sound pressure, the sound pressure naturally released by the adjusting holes 377H and 339H is increased accordingly, so that the sound pressure generated by the sub-speakers 340B and 350 connected to the chamber tube is controlled by the main chamber. While the sub-speakers 340B and 350 connected to the chamber tube generate a small sound pressure, the sound pressure naturally released by the adjusting holes 377H and 339H is reduced accordingly, so that the sound generated by the external speaker connected to the chamber tube can still be heard clearly in the main chamber. The adjusting holes 377H and 339H can be replaced by a set of adjusting holes having a plurality of holes.

Figure 3B:
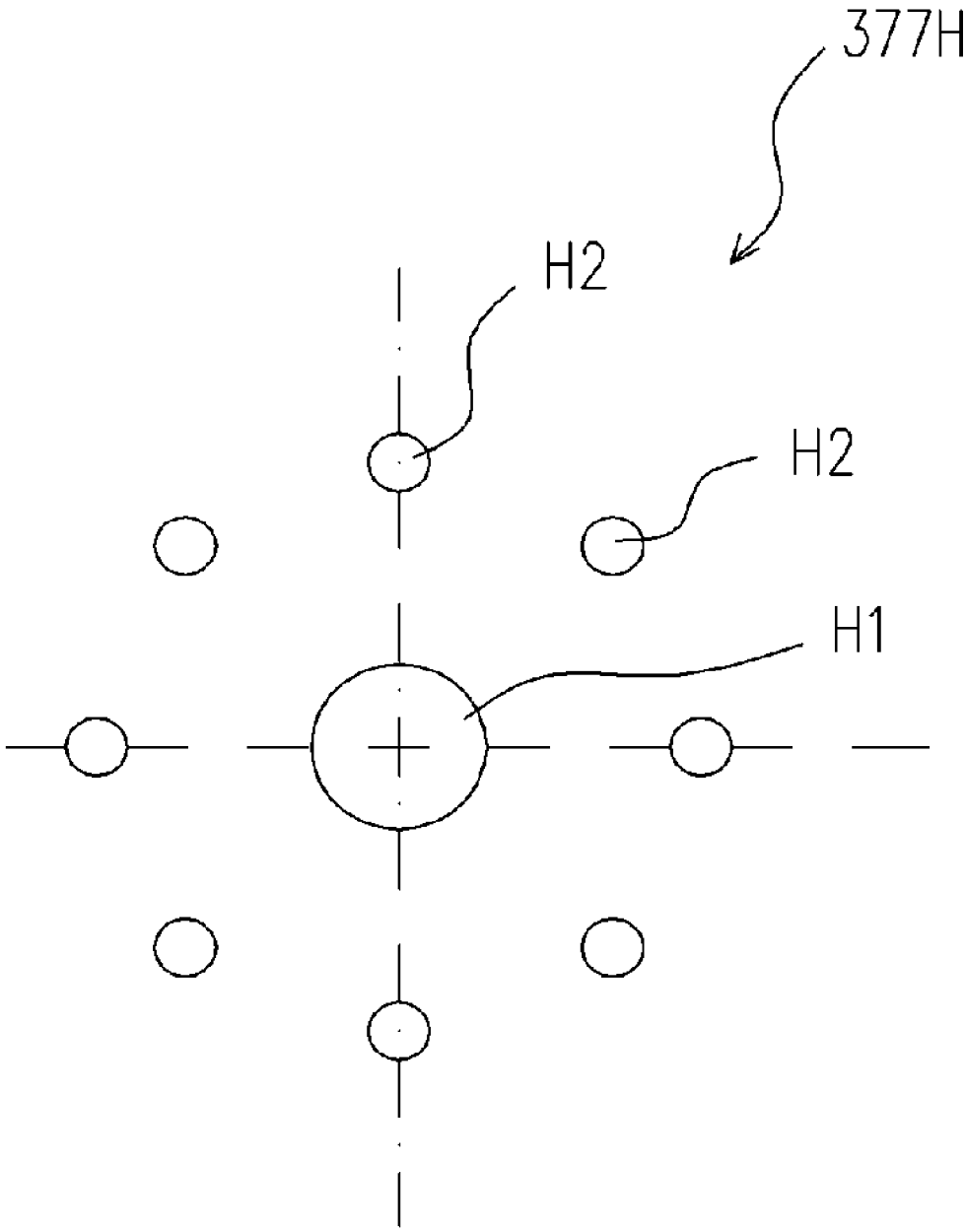
FIG. 3B is a diagram illustrating the disposition of an adjusting hole on the extended chamber pipe according to an embodiment of the present invention.

The adjusting holes 377H and 339H in the present invention have holes for naturally releasing sound pressure. However, the added adjusting holes 377H and 339H can also be replaced by a set of adjusting holes having a plurality of holes. The apertures of the adjusting holes or the holes of the set of adjusting holes can be designed according to the size of the formed chamber tube, the characteristic of the speakers, the frequency of the speakers etc. The holes of the set of adjusting holes can be arranged according to the different designs. For example, in an embodiment, referring to FIG. 3B, the adjusting hole 377H in FIG. 3A is replaced by a set of adjusting holes having a hole H1 with large aperture and holes H2 with eight evenly distributed small apertures, the aperture of the hole H1 is, for example, 2 mm (millimeter), and the apertures of the holes H2 are, for example, 1 mm.

Figure 3C:
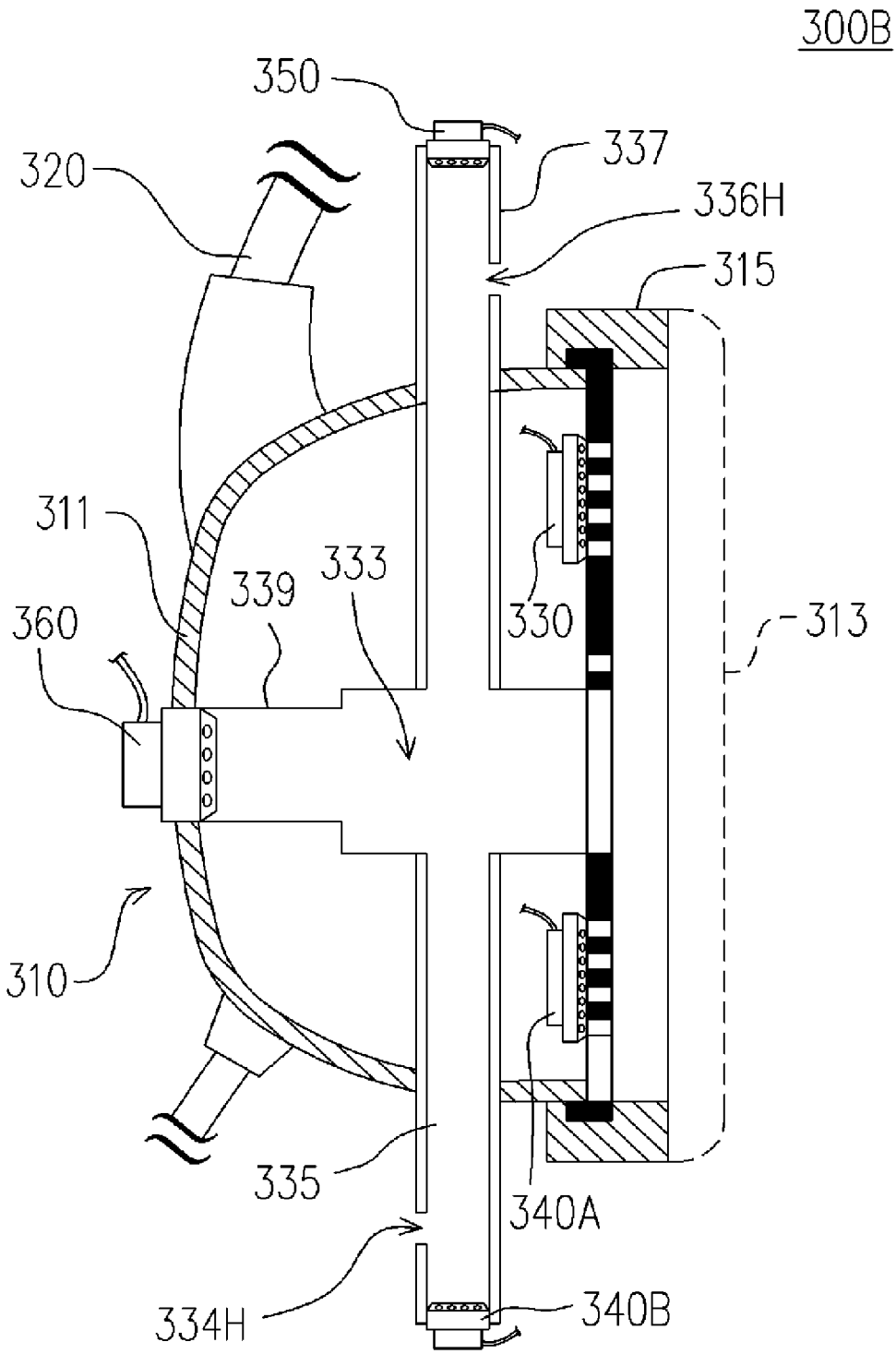
FIG. 3C is a partial side cross-sectional diagram of an earphone according to yet another embodiment of the present invention.

FIG. 3C is a partial side cross-sectional diagram of an earphone 300B according to another exemplary embodiment of the present invention. It is remarkable that even though FIG. 3C illustrates only one side of the earphone of the present invention, it should be understood by those skilled in the art that the structure of the other side not shown in FIG. 3C is the same as that of the side shown in FIG. 3C, so will not be described here again.

Referring to FIG. 3C, the earphone 300B includes a main body 310 and a connector 320. Wherein, the connector 320 is used for connecting the main bodies 310 (only one is shown in the figure) at both sides. The main body 310 is formed by a case 311, a cover 313, and a case extension 315, and the case extension 315 is the extension of the case 311 and is connected to the cover 313. The main body 310 includes a main speaker 330 and a plurality of sub-speakers 340A, 340B, 350, and 360. The sub-speakers 340B and 350 are respectively disposed on the extended chamber pipes 335 and 337 on the sidewalls at both sides of the composite chamber tube 333, however, in another embodiment, the sub-speakers 340B and 350 may also be directly disposed on the sidewalls of both sides of the composite chamber tube 333.

The difference between the earphone structure 300B and the earphone structure in FIG. 3A is that the extended chamber pipe 339 extends directly from the composite chamber tube 333 so as to dispose the sub-speaker 360 on the case 311. The case 311, cover 313, and case extension 315 of the earphone 300B form a main chamber, and the depth and extent of the sound field are increased through the structure of composite chamber tube 333 and the extended chamber pipes 335, 337, and 339.

The adjusting holes 334H and 336H added in the chamber tube formed by the extended chamber pipes 335 and 337 naturally released the sound pressure of the chamber tube. While the pipes at their shortest status, the sound pressure in the chamber tube does not affect the performance of the main chamber sound field. While the sub-speakers 340B and 350 connected to the chamber tube generate a large sound pressure, the sound pressure naturally released by the adjusting holes 334H and 336H is increased accordingly, so that the sound pressure generated by the sub-speakers connected to the chamber tube is controlled by the main chamber. While the sub-speakers 340B and 350 connected to the chamber tube generate a small sound pressure, the sound pressure naturally released by the adjusting holes 334H and 336H is reduced accordingly, so that the sound generated by the external speaker connected to the chamber tube can still be heard clearly in the main chamber.

Figure 4A:
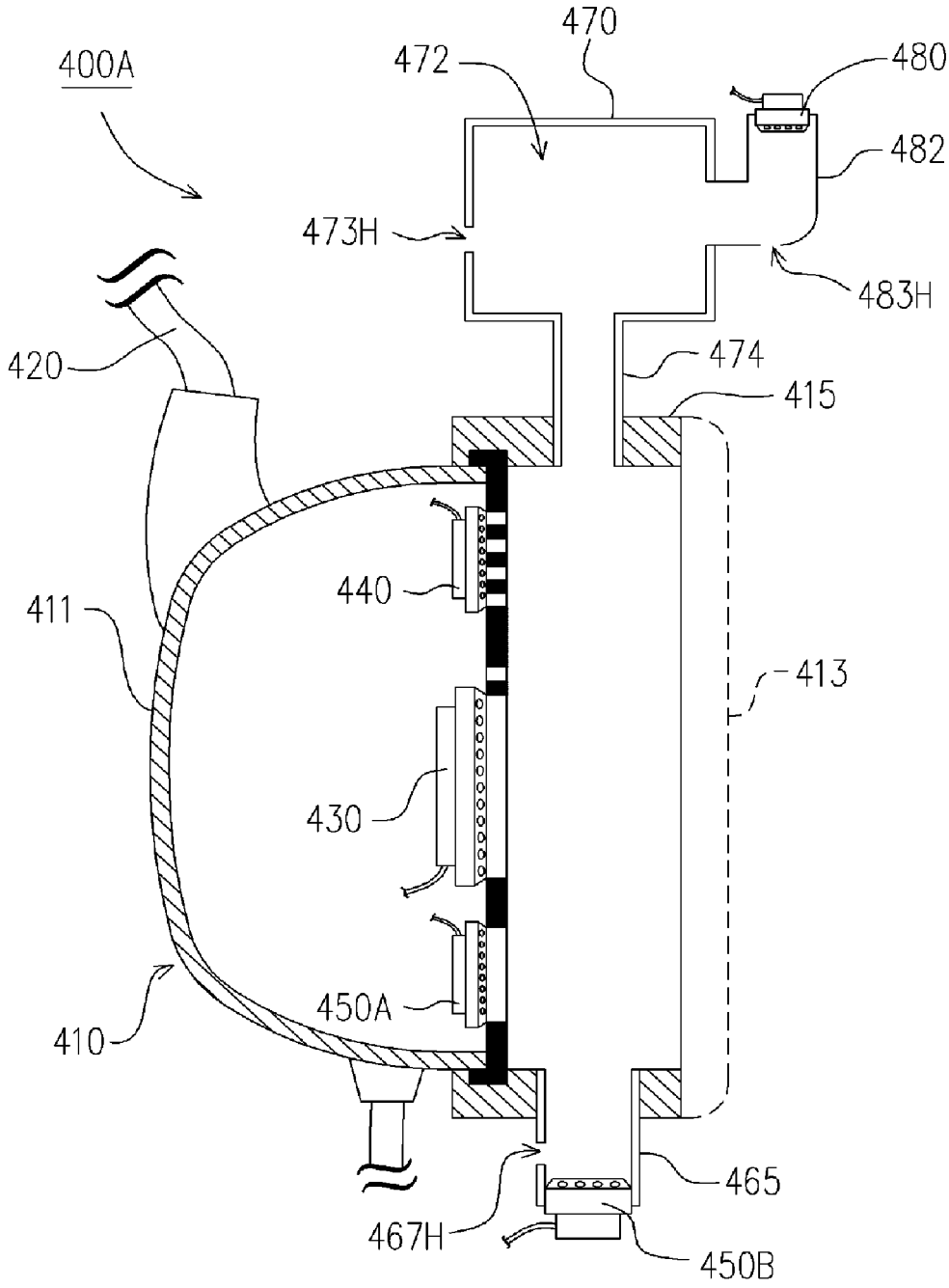
FIGS. 4A~4B are partial side cross-sectional views of an earphone according to yet another embodiment of the present invention.

FIG. 4A is a partial side cross-sectional views of an earphone 400A according to yet another embodiment of the present invention. It is remarkable that even though FIG. 4A illustrates only one side of the earphone in the present invention, it should be understood by those skilled in the art that the structure of the other side is the same, so will not be described again.

Referring to FIG. 4A, the earphone 400A includes a main body 410 and a connector 420. Wherein, the connector 420 is used for connecting the main bodies 410 (only one is shown in the figure) at both sides. The main body 410 is formed by a case 411, a cover 413, and a case extension 415. A main speaker 430 and a plurality of sub-speakers 440 and 450A can be disposed in the main body 410. An extended chamber pipe 465 for disposing the sub-speaker 450B is further included. A chamber tube 470 connected to an extended chamber pipe 474 is further included. The adjusting holes 467H and 473H are respectively disposed in the extended chamber pipe 465 and the chamber tube 470. The adjusting hole is defined here as a hole for naturally releasing sound pressure. The adjusting hole can be replaced by a set of adjusting holes having a plurality of holes, and different position designs are also provided. The earphone 400A may include both or one of the extended chamber pipe 465 and the chamber tube 470 connected to the extended chamber pipe 474. The earphone 400A will be explained in detail below.

As described above, the earphone 400A may have only an extended chamber pipe 465 disposed on the case extension 415 of the main body 410. The case 411 and the cover 413 of the earphone 400A form a main chamber, and the depth and extent of the sound field are increased through adjusting the structure of the extended chamber pipe 465. In the present embodiment, retracting method is used for adjusting the structure of the extended pipe. The adjusting hole 467H is added into the chamber tube formed by the extended chamber pipe 465 so as to naturally release the sound pressure in the chamber tube. While the pipe is at its shortest status, the sound pressure will not affect the performance of the main chamber sound field.

In the present embodiment, an earphone 400A with sound field partition function is further provided besides the structure of extended chamber pipe 465. An extended chamber pipe 474 is connected at the external of the case extension 415 of the main body 410, and a chamber tube 470 is formed at the outmost edge of the extended chamber pipe 474 to form a chamber 472 in the chamber tube 470. The chamber tube 470 has an adjusting hole 473H. The position of the adjusting hole can be adjusted and can be replaced by a set of adjusting holes.

While the sound pressure in the chamber tube 470 is large, the sound pressure released naturally by the adjusting hole 473H is increased accordingly, so that the sound pressure produced by the sub-speaker connected to the chamber tube is controlled in the main chamber. While the sound pressure in the chamber tube 470 is small, the sound pressure released naturally by the adjusting hole 473H is reduced accordingly, so that the sound produced by the external speaker connected to the chamber tube can still be heard clearly in the main chamber. In the present embodiment, the chamber tube 470 may also have an extended chamber pipe 482, and a sub-speaker 480 is disposed therein. Thus, in an embodiment, an adjusting hole can also be disposed on the extended chamber pipe 482, as the adjusting hole 483H shown in the figure. The adjusting hole 483H may be a single hole or a set of adjusting holes.

Figure 4B:
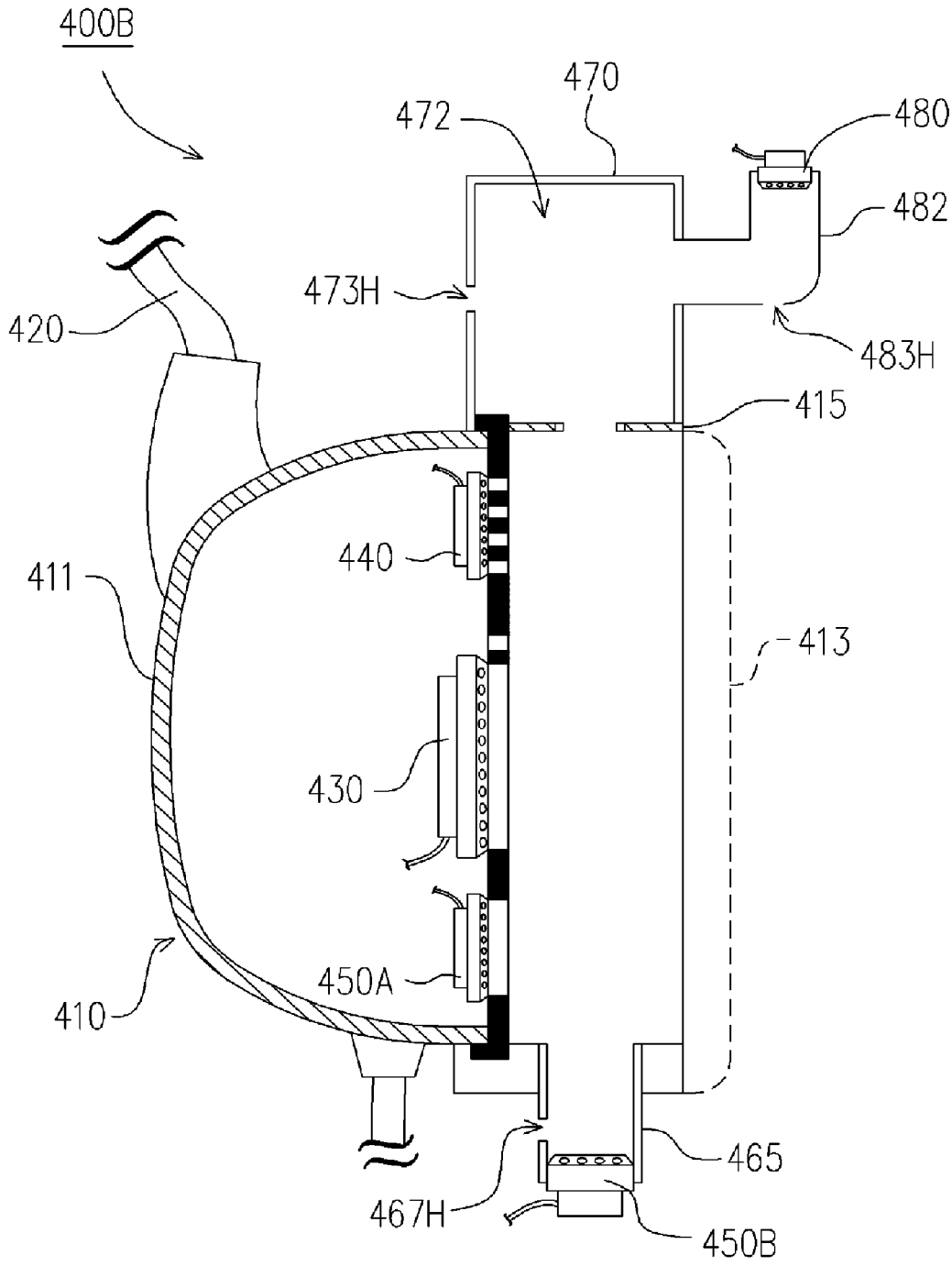

Referring to FIG. 4B, the earphone 400A includes a main body 410 and a connector 420. Wherein the connector 420 is used for connecting the main bodies 410 (only one is shown in the figure) at both sides. The main body 410 is formed by a case 411, a cover 413, and a case extension 415. A main speaker 430 and a plurality of sub-speakers 440 and 450A can be disposed in the main body 410. An extended chamber pipe 465 for disposing the sub-speaker 450B is further included. The difference from FIG. 4A is that the extended chamber tube 470 is directly disposed on the case extension 415 without the extended chamber pipe. The extended chamber pipe 465 and the chamber tube 470 have the adjusting hole 467H and the adjusting hole 473H respectively. The adjusting hole defined here as a hole for naturally releasing sound pressure. The adjusting hole may also be replaced by a set of adjusting holes, which, for example, can be adjusted according to the sound frequency. The earphone 400B includes the extended chamber pipe 465 and the chamber tube 470, or either one, which will be described in detail below.

In the present embodiment, an earphone 400B having sound field partition function is further provided besides the structure with the extended chamber pipe 465. Wherein, a chamber tube 470 is connected to the external of the case extension 415 of the main body 410, and a chamber 472 is formed in the chamber tube 470. The chamber tube 470 has an adjusting hole 473H. Here the adjusting hole can be replace by a set of adjusting holes, and the aperture thereof can be adjusted according to the design, for example, the frequency range.

When the sound pressure in the chamber tube 470 is large, the sound pressure naturally released by the adjusting hole 473H is increased accordingly, so that the sound pressure produced by the sub-speaker connected to the chamber tube is controlled by the main chamber. While the sound pressure in the chamber tube 470 is small, the sound pressure naturally released by the adjusting hole 473H is reduced accordingly, so that the sound produced by the external speaker connected to the chamber tube can still be heard clearly in the main chamber. In another embodiment, the chamber tube 470 may further have an extended chamber pipe 482, and a sub-speaker 480 is disposed therein. Thus, in an embodiment, an adjusting hole can be disposed on the extended chamber pipe 482, as the adjusting hole 483H shown in the figure.

Figure 5A:
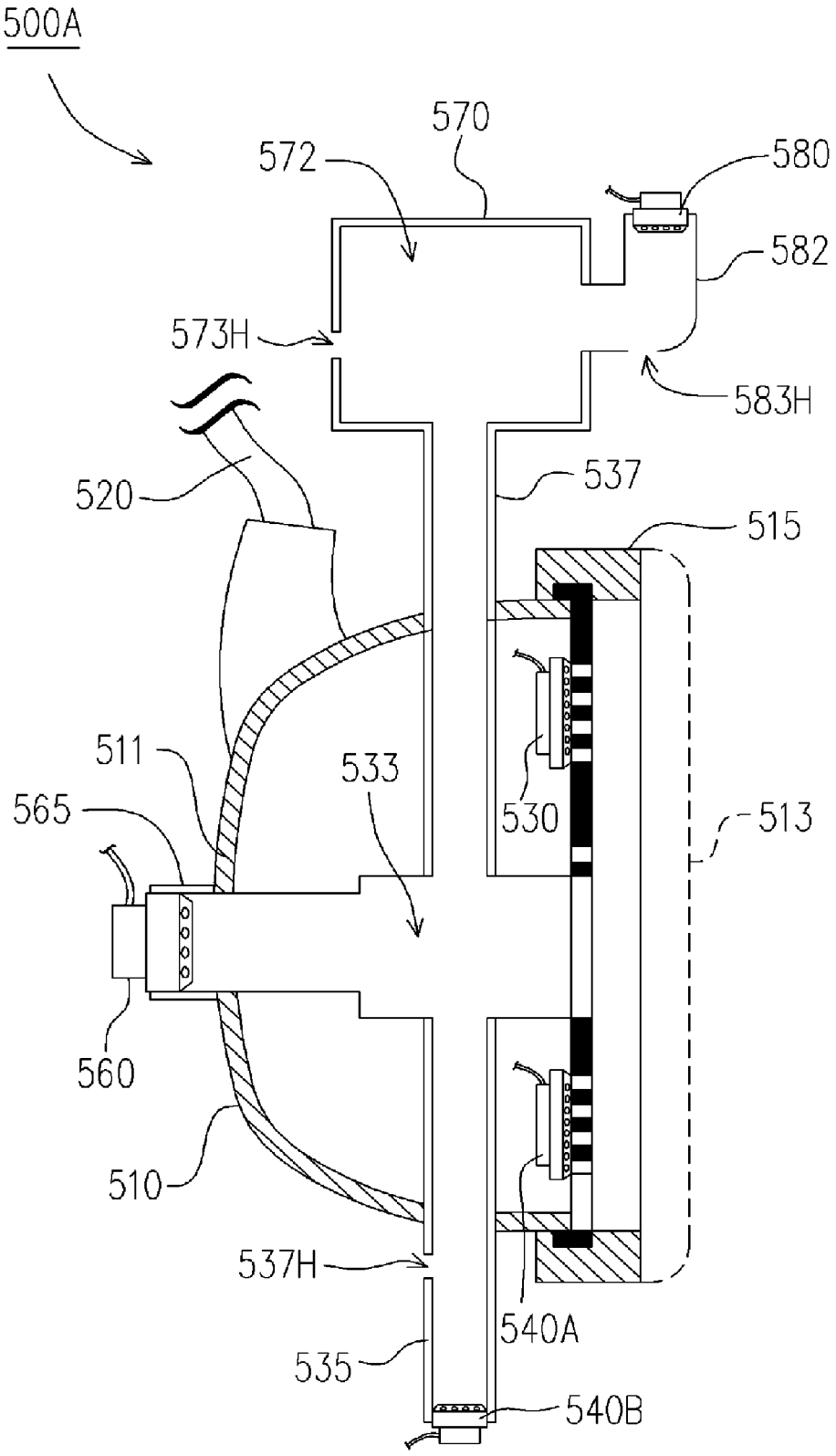
FIGS. 5A~5B are partial side cross-sectional views of an earphone according to yet another embodiment of the present invention.

FIG. 5A is a partial side cross-sectional view of an earphone 500A according to yet another embodiment of the present invention. It is remarkable that even only one side of the earphone is illustrated in FIG. 5A, it should be understood by those skilled in the art that the structure of the other side is the same, so will not be described again.

Referring to FIG. 5A, the earphone 500A includes a main body 510 and a connector 520. Wherein, the connector 520 is used for connecting the main bodies 510 at both sides (only one is shown in the figure). The main body 510 is formed by a case 511, a cover 513, and a case extension 515. A main speaker 530 and a plurality of sub-speakers 540A, 540B, 560, and 580 may be disposed in the main body 510. The sub-speaker 540B is disposed on the extended chamber pipe 535 extended from the sidewall of the composite chamber tube 533. An extended chamber pipe 565 for disposing the sub-speaker 560 is further included. A chamber tube 570 connected to an extended chamber pipe 537 is further included. The extended chamber pipe 535 and the chamber tube 570 have the adjusting hole 537H and adjusting hole 573H respectively. Here the adjusting hole is defined as a hole for naturally releasing sound pressure. The adjusting hole can be replace by a set of adjusting holes, which will be described in detail below.

The difference of the earphone 500A from the earphone structures in FIG. 4A and FIG. 4B is that the extended chamber pipes 565 and 537 in FIG. 5A are disposed on the case 511 of the main body 510, and the composite chamber tube 533 in the main body 510 extends outwardly. In the earphone 500A, as described above, there may be only one extended chamber pipe 565 disposed on the case 511 of the main body 510. The case 511 and the cover 513 of the earphone 500A form the main chamber. The adjusting hole 537H added to the chamber tube formed by the extended chamber pipe 535 naturally releases the sound pressure of the chamber tube, and while the pipe is at its shortest status, the sound pressure in the chamber tube will not affect the performance of the main chamber sound field.

The present embodiment provides an earphone 500A with sound field partition function. An extended chamber pipe 537 is extended outwardly from the side wall of the composite chamber tube 533 of the main body 510, and a chamber tube 570 is formed at the outmost edge of the extended chamber pipe 537, so as to form a chamber 572 in the chamber tube 570.

While the sound pressure in the chamber tube 570 is large, the sound pressure naturally released by the adjusting hole 573H is increased accordingly, so that the sound pressure produced by the sub-speaker connected to the chamber tube is controlled in the main chamber. While the sound pressure in the chamber tube 570 is small, the sound pressure naturally released by the adjusting hole 573H is reduced accordingly, so that the sound produced by the external speaker connected to the chamber tube can still be heard clearly in the main chamber. The chamber tube 570 in the present embodiment may also have an extended chamber pipe 582, and a sub-speaker 580 is disposed therein. Thus, in an embodiment, an adjusting hole may also be disposed on the extended chamber pipe 582 as the adjusting hole 583H shown in the figure.

Figure 5B:
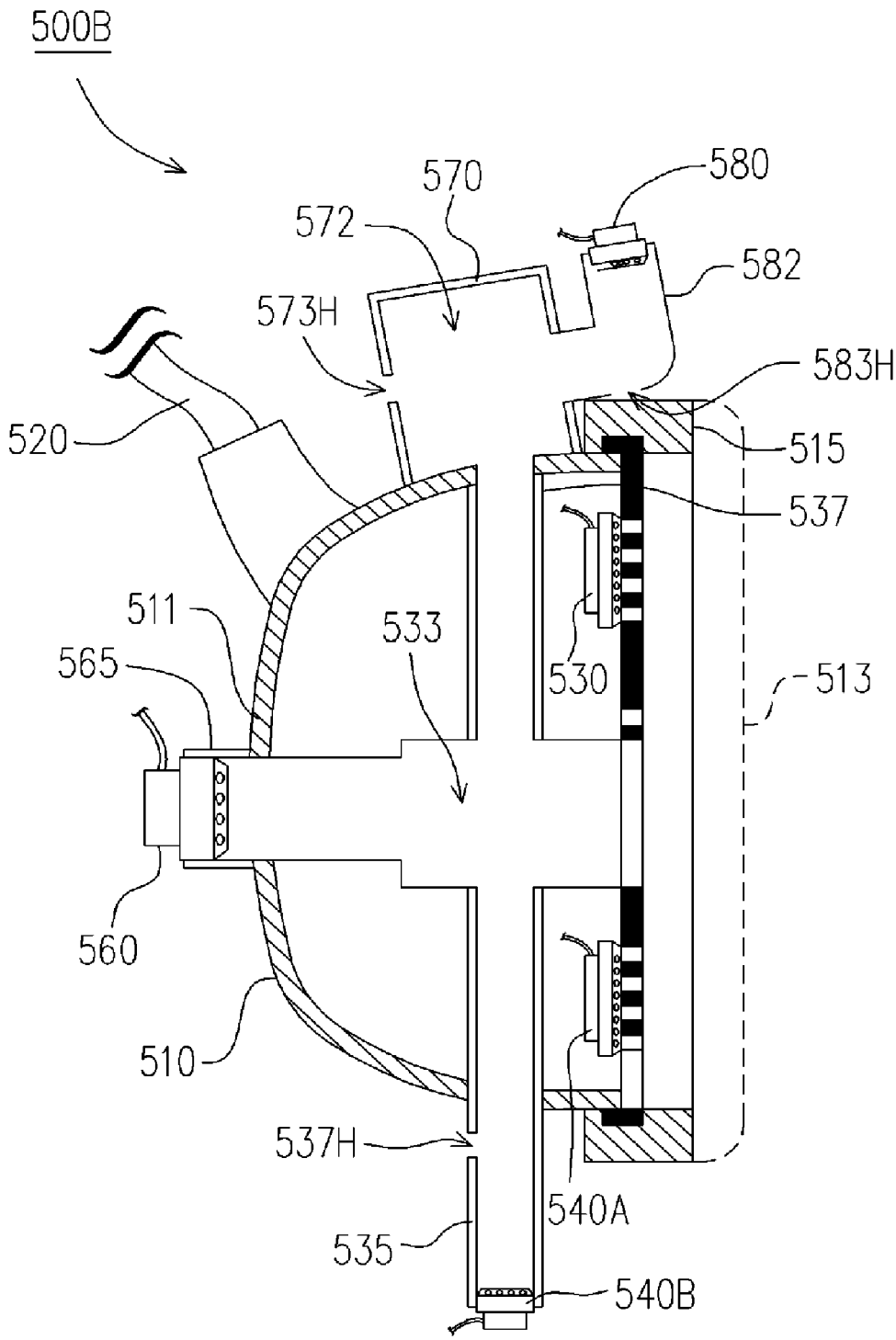

FIG. 5B is a partial side cross-sectional view of an earphone 500B according to yet another embodiment of the present invention. It is remarkable that even though only one side of the earphone 500B is illustrated in FIG. 5B, it should be understood by those skilled in the art that the structure of the other side is the same, so will not be described again.

Referring to FIG. 5B, the earphone 500B includes a main body 510 and a connector 520. Wherein, the connector 520 is used for connecting the main bodies 510 at both sides (only one is shown in the figure). The main body 510 is formed by a case 511, a cover 513, and a case extension 515. A main speaker 530 and a plurality of sub-speakers 540A, 540B, 560, and 580 are disposed in the main body 510. The sub-speaker 540B is disposed on the extended chamber pipe 535 extended outwardly from the sidewall of the composite chamber tube 533. An extended chamber pipe 565 for disposing the sub-speaker 560 is further included. A chamber tube 570 connected to an extended chamber pipe 537 is further included. The extended chamber pipe 535 and the chamber tube 570 have an adjusting hole 537H and an adjusting hole 573H respectively. Here the adjusting hole is defined as a hole for naturally releasing sound pressure. The adjusting hole can be replaced by a set of adjusting holes, which will be described in detail below.

The case 511 and the cover 513 of the earphone 500B form a main chamber, and the adjusting hole 537H added in the chamber tube formed by the extended chamber pipe 535 naturally releases the sound pressure in the chamber tube. While the pipe is at its shortest status, the sound pressure in the chamber tube will not affect the performance of the main chamber sound field.

The present embodiment further provides an earphone with sound field partition function besides the structure with extended chamber pipe. The difference of the earphone 500B from the earphone structure in FIG. 5A is that the chamber tube 570 in FIG. 5B is disposed on the case 511 of the main body 510, and extended outwardly from the composite chamber tube 533 in the main body 510, so as to form the chamber 572 in the chamber tube 570.

While the sound pressure in the chamber tube 570 is large, the sound pressure naturally released by the adjusting hole 573H is increased accordingly, so that the sound pressure produced by the sub-speaker connected to the chamber tube is controlled in the main chamber. While the sound pressure in the chamber tube 570 is small, the sound pressure naturally released by the adjusting hole 573H is reduced accordingly, so that the sound produced by the external speaker connected to the chamber tube can still be heard clearly in the main chamber. The chamber tube 570 of the present embodiment may also have an extended chamber pipe 582, and a sub-speaker 580 is disposed therein. Thus, in an embodiment, an adjusting hole can also be disposed on the extended chamber pipe 582, as the adjusting hole 583H in the figure.

As described above, the earphone structure provided by the present invention has an extended chamber pipe disposed on the case. The case and cover of the earphone structure form a chamber tube, and the depth and extent of the sound field are increased through adjusting the structure of the extended pipe, and further the phase of the sound field can be adjusted. In addition, the adjusting hole added in the chamber tube formed by the extended chamber pipe naturally releases the sound pressure in the chamber tube, and while the pipe is at its shortest status, the sound pressure in the chamber tube will not affect the performance of the main chamber sound field.

While the external speaker connected to the chamber tube produces a large sound pressure, the sound pressure naturally released by the adjusting hole is increased accordingly, so that the sound pressure produced by the external speaker connected to the chamber tube is controlled in the main chamber. While the external speaker connected to the chamber tube produces a small sound pressure, the sound pressure naturally released by the adjusting hole is reduced accordingly, so that the sound produced by the external speaker connected to the chamber tube can still be heard clearly in the main chamber.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An earphone structure, comprising:

a main body, comprising a case, a cover, and a case extension for forming a main chamber tube;

a main speaker and a plurality of sub-speakers, wherein the main speaker and a part of the sub-speakers are disposed in the case; and a first extended chamber pipe, disposed on the main body, extending to the case to form a composite chamber tube, the first extended chamber pipe has a first adjusting hole set for adjusting the sound field characteristic of the composite chamber tube formed in the earphone structure, wherein the first adjusting hole set is positioned outside the case.

2. The earphone structure as claimed in claim 1, wherein the first adjusting hole set has one hole.

3. The earphone structure as claimed in claim 2, wherein the aperture of the hole is designed according to the size of the chamber tube of the first extended chamber pipe.

4. The earphone structure as claimed in claim 2, wherein the aperture of the hole is designed according to a frequency.

5. The earphone structure as claimed in claim 1, wherein the first extended chamber pipe is disposed on the case extension of the main body.

6. The earphone structure as claimed in claim 1, wherein one of the sub-speakers is disposed on the first extended chamber pipe.

7. The earphone structure as claimed in claim 1 further comprising a chamber tube disposed at the external of the case to form a resonate chamber in the chamber tube, wherein the chamber tube has an adjusting hole set, and the sound pressure in the chamber tube is released through the adjusting hole set of the chamber tube while the sound wave in the resonate chamber is transmitted to the sound field in the main body through air.

8. The earphone structure as claimed in claim 7 further comprising a curved pipe connected to the external of the chamber tube for adjusting the resonate chamber.

9. The earphone structure as claimed in claim 8, wherein one of the sub-speakers is disposed at the external of the curved pipe.

10. An earphone structure, comprising:

a main body, comprising a case, a cover, and a case extension for forming a main chamber tube;

a main speaker and a plurality of sub-speakers, wherein the main speaker and a part of the sub-speakers being disposed in the case;

a first extended chamber pipe, disposed on the main body, extending to the case to form a composite chamber tube, the first extended chamber pipe has a first adjusting hole set for adjusting the sound field characteristic of the composite chamber tube formed in the earphone structure; and a second extended chamber pipe disposed on the main body and extending into the case to form the composite chamber tube with the first extended chamber pipe, the second extended chamber pipe has a second adjusting hole for adjusting the sound field characteristic of the composite chamber tube formed in the earphone structure.

11. The earphone structure as claimed in claim 10, wherein the second extended chamber pipe is disposed on the case extension of the main body.

12. The earphone structure as claimed in claim 10, wherein the second extended chamber pipe is disposed on the case of the main body.

13. An earphone structure, comprising:

a main body, comprising a case, a cover, and a case extension for forming a main chamber tube;

a main speaker and a plurality of sub-speakers, wherein the main speaker and a part of the sub-speakers being disposed in the case;

a first extended chamber pipe, disposed on the main body, the first extended chamber pipe having a first adjusting hole for adjusting the sound field characteristic of the earphone structure; and a chamber tube, disposed at the external of the case extension to form a resonate chamber in the chamber tube, wherein the chamber tube has an adjusting hole set, and the sound pressure in the chamber tube is released through the adjusting hole set while the sound wave in the resonating chamber is transmitted to the sound field in the main body through air.

14. The earphone structure as claimed in claim 13 further comprising a curved pipe connected to the external of the chamber tube for adjusting the resonate chamber.

15. The earphone structure as claimed in claim 13, wherein one of the sub-speakers is disposed at the external of the curved pipe.

16. An earphone structure, comprising:

a main body, comprising a case, a cover, and a case extension for forming a main chamber tube;

a main speaker and a plurality of sub-speakers, the main speaker and a part of the sub-speakers are disposed in the case; and a chamber tube, disposed on the main body, the chamber tube having a set of adjusting holes for adjusting the sound field characteristic formed in the earphone structure, wherein the set of adjusting holes are formed by a plurality of holes positioned outside the case.

17. The earphone structure as claimed in claim 16, wherein the apertures of the holes are designed according to the size of the chamber tube.

18. The earphone structure as claimed in claim 16, wherein the apertures of the holes are designed according to a frequency.

19. The earphone structure as claimed in claim 16, wherein the apertures of the holes are not the same.

* * * * *